US009985419B2

(12) United States Patent
Wüstenhagen

(10) Patent No.: US 9,985,419 B2
(45) Date of Patent: May 29, 2018

(54) VOLTAGE TRANSFORMER CIRCUIT AND METHOD FOR IONIC CURRENT MEASUREMENT OF A SPARK PLUG

(71) Applicant: BorgWarner Ludwigsburg GmbH, Ludwigsburg (DE)

(72) Inventor: Dirk Wüstenhagen, Auma (DE)

(73) Assignee: BORGWARNER LUDWIGSBURG GMBH, Ludwigsburg (DE)

( * ) Notice: Subject to any disclaimer, the term of this patent is extended or adjusted under 35 U.S.C. 154(b) by 3 days.

(21) Appl. No.: 15/234,522

(22) Filed: Aug. 11, 2016

(65) Prior Publication Data

US 2017/0047713 A1 Feb. 16, 2017

(30) Foreign Application Priority Data

Aug. 14, 2015 (DE) ..... 10 2015 113 475

(51) Int. Cl.

| | |
|---|---|
| ***H01T 15/00*** | (2006.01) |
| ***F02P 17/12*** | (2006.01) |
| ***F02P 3/08*** | (2006.01) |
| ***F02P 3/04*** | (2006.01) |

(Continued)

(52) U.S. Cl.

CPC ..... *H01T 15/00* (2013.01); *F02P 3/0435* (2013.01); *F02P 3/08* (2013.01); *F02P 17/12* (2013.01); *F02P 2017/125* (2013.01); *H01T 13/40* (2013.01); *H01T 13/50* (2013.01)

(58) Field of Classification Search

CPC ..... H01T 15/00; F02P 17/00–17/12; F02P 2017/003; F02P 2017/006; F02P 2017/121–2017/128; F02P 3/02–3/0435

See application file for complete search history.

(56) References Cited

U.S. PATENT DOCUMENTS 4,601,193 A * 7/1986 Blauhut ..... F02P 5/152 73/114.67

4,987,771 A 1/1991 Iwata (Continued)

FOREIGN PATENT DOCUMENTS

DE 39 34 310 A1 4/1990

DE 199 12 376 A1 9/2000

(Continued)

*Primary Examiner* — Huy Q Phan

*Assistant Examiner* — David Frederiksen

(74) *Attorney, Agent, or Firm* — Bose McKinney & Evans LLP

(57) ABSTRACT

A voltage transformer circuit is described for supplying a spark plug with ignition energy and for ionic current measurement. A transformer of the circuit generates a secondary voltage from a primary voltage and applies the secondary voltage to the spark plug to ignite an electric arc. Using a current effected by the secondary voltage, a capacitor is charged to a breakdown voltage of a Zener diode bridging the same, via a first branch, which leads from the transformer to a first of two sides of the capacitor. The primary voltage is disconnected from the transformer in order to extinguish the electric arc. The capacitor delivers charges for an ionic current via a second branch, which connects the second side of the capacitor to the transformer. A measuring signal of the ionic current is obtained by measuring a voltage drop at a measuring resistor.

13 Claims, 5 Drawing Sheets

(51) Int. Cl.
*H01T 13/40* (2006.01)
*H01T 13/50* (2006.01)

(56) References Cited

U.S. PATENT DOCUMENTS

| | | | | |
|---|---|---|---|---|
| 5,781,012 | A * | 7/1998 | Yasuda | F02P 17/12 324/388 |
| 5,866,808 | A | 2/1999 | Ooyabu et al. | |
| 6,040,698 | A * | 3/2000 | Takahashi | F02P 17/12 324/378 |
| 6,186,129 | B1 * | 2/2001 | Butler, Jr. | F02P 17/12 123/406.26 |
| 6,222,367 | B1 * | 4/2001 | Shimizu | F02P 17/12 324/378 |
| 2003/0164025 | A1 * | 9/2003 | Kiess | F02P 17/12 73/35.08 |
| 2011/0080174 | A1 * | 4/2011 | Petruska | F02P 17/12 324/459 |
| 2011/0210745 | A1 * | 9/2011 | Barrett | F02P 17/12 324/388 |

FOREIGN PATENT DOCUMENTS

| | | | |
|---|---|---|---|
| JP | 2011-38488 | A | 2/2011 |
| JP | 2014-70505 | A | 4/2014 |

* cited by examiner

VOLTAGE TRANSFORMER CIRCUIT AND METHOD FOR IONIC CURRENT MEASUREMENT OF A SPARK PLUG

RELATED APPLICATIONS

This application claims priority to DE 10 2015 113 475.6, filed Aug. 14, 2015, the entire disclosure of which is hereby incorporated herein by reference in its entirety.

BACKGROUND

The invention relates to a voltage transformer circuit for a spark plug and a method for ionic current measurement.

An arc discharge is created between the electrodes of a spark plug by applying a high voltage, in order to ignite fuel in the combustion chamber of an engine. If no arc discharge is burning, it is possible, by applying a somewhat lower voltage, to measure the electrical conductance of the gas mixture between the electrodes of the spark plug. An ionic current measurement of this type makes it possible to obtain valuable information about the state of the combustion chamber of the engine. Ignition systems which allow ionic current measurements are for example known from U.S. Pat. No. 5,866,808 and DE 39 34 310 A1.

Ignition systems of this type consist of a spark plug and a voltage transformer circuit, which generates a secondary voltage of more than 10 kV from a primary voltage, generally the vehicle system voltage of a vehicle, by means of a transformer. When the primary voltage is applied to the transformer, a strong magnetic field change immediately occurs on the secondary side thereof, so that a voltage is induced in the electrodes of the spark plug. Under certain circumstances, this may already lead to an arc discharge and thus effect an undesired premature ignition of the mixture in the combustion chamber of the engine. To prevent this, modern ignition systems are often equipped with a switch-on spark suppression diode, which is arranged between the spark plug and the transformer. The switch-on spark suppression diode blocks a secondary current, which is caused by switching on the ignition system, that is to say the application of the primary voltage, and therefore prevents a premature voltage increase at the electrodes of the spark plug.

Ignition systems which contain a switch-on spark suppression diode and allow ionic current measurement are problematic in that the vehicle system voltage of a vehicle is not sufficient for ionic current measurement because of the relatively high electrical resistance of the combustion chamber contents. Rather, a higher voltage is required, typically about 100 V or more. In ignition systems without a switch-on spark suppression diode, the voltage for ionic current measurement is delivered by a capacitor, which is charged by the secondary voltage of the voltage transformer circuit, whilst the secondary voltage is applied at the spark plug. A corresponding circuit is illustrated in FIG. 1. After the arc discharge is extinguished, the capacitor is discharged by means of an ionic current, which flows between the electrodes of the spark plug. Using this circuit, the ionic current can be measured as a voltage drop at the resistor. The discharge current of the capacitor of such a circuit flows in the opposite direction through the spark plug to the charging current of the same, which effects an arc discharge of the spark plug. A switch-on spark suppression diode would therefore block the discharge current of the capacitor and therefore also of the ionic current.

It is inherently possible to generate the voltage for an ionic current measurement from the vehicle system voltage by means of a further voltage transformer. However, this possibility is very complex and it has therefore not been possible for it to gain popularity.

SUMMARY

The present disclosure teaches a way in which the advantages of a switch-on spark suppression diode can cost-effectively be combined with the option of ionic current measurement.

According to this disclosure, the secondary voltage generated by a transformer of the voltage transformer circuit is used for charging a capacitor, which is arranged in a loop, which is connected in series to the secondary side of the transformer. The loop therefore consists of a first branch, which leads from a branching point to a first side of the capacitor, and a second branch, which leads from the branching point to the second side of the capacitor. Thus, the two sides of the capacitor are connected to the same end of the secondary side of the transformer. Current can flow through the first branch for charging the capacitor and through the second branch for discharging. On the secondary side of the transformer, the charging current and the discharging current of the capacitor therefore have the same direction and consequently can both flow through a switch-on spark suppression diode arranged between the spark plug and secondary side of the transformer.

In order to prevent the capacitor from discharging prematurely, diodes may be contained in the first and the second branch of the loop, which are orientated in an opposing manner and therefore ensure that only a charging current flows through the one branch and only a discharging current flows through the other branch. One or both diodes can however also be replaced by a switch which is only closed if current should flow through the relevant branch. In this manner, it can likewise be achieved that the charging current only flows through one of the two branches and the discharging current only flows through the other of the two branches of the loop.

The capacitor arranged in the loop delivers charges for an ionic current after the extinguishing of the arc discharge. The charges stored in the capacitor can be used directly for an ionic current in this case, which then flows as a discharging current of the capacitor. A different option consists in using the capacitor to charge a second capacitor, which then feeds the ionic current. In this case, the ionic current can be fed both by the first and by the second capacitor at the same time. As the charges of the second capacitor originate from the first capacitor, the charges of the ionic current are also ultimately delivered by the first capacitor when using a second capacitor.

The second capacitor can be arranged in a circuit branch which branches from the first branch of the loop and leads to ground potential. A measuring resistor can be arranged in this circuit branch, which is connected in series to the second capacitor. At a measuring resistor of this type, a voltage drop proportional to the ionic current can be measured with less outlay than at a resistor, which is arranged in the second branch of the loop for example.

An advantageous refinement of this disclosure provides that a resistor is arranged in the second branch of the loop, through which the ionic current flows, for example a resistor of 10 kOhm or more, particularly 100 kOhm to 1 MOhm. This resistance ensures that the charging current first flows through the first branch of the loop.

When a diode or the breakdown voltage of a diode are mentioned in the context of this disclosure, diode cascades should also be included therewith, that is to say a plurality of diodes connected in series, which as a whole naturally have a higher breakdown voltage than a single diode.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
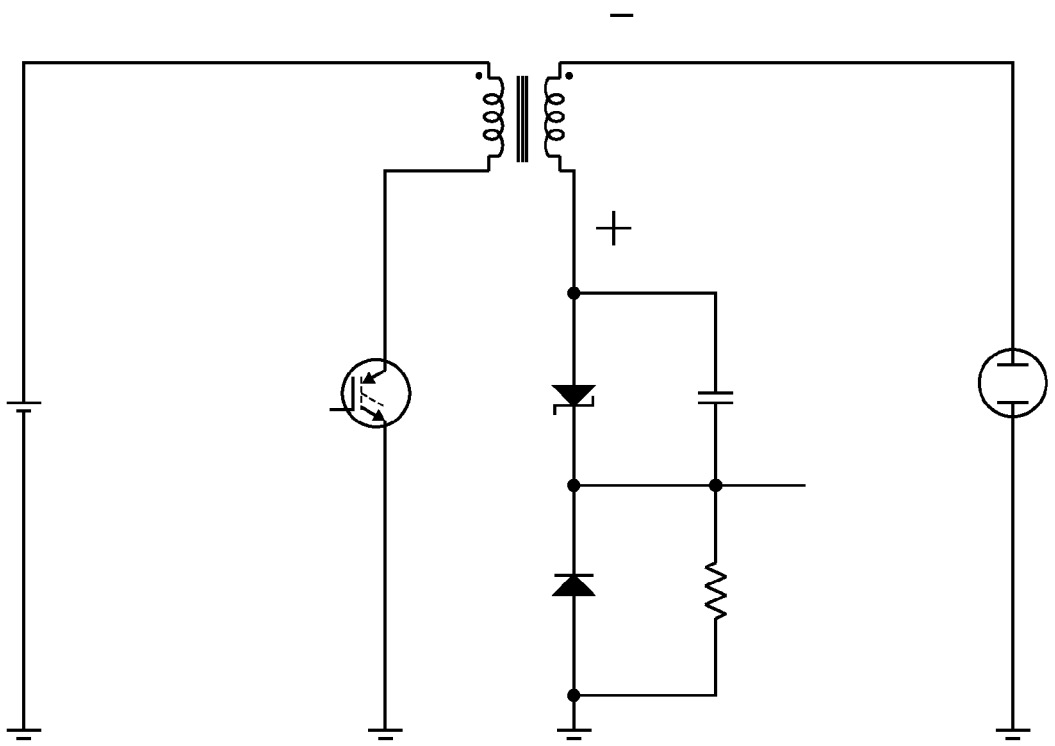
FIG. 1 shows a circuit diagram representing an ignition system without a switch-on spark suppression diode, as discussed above.
Figure 2:
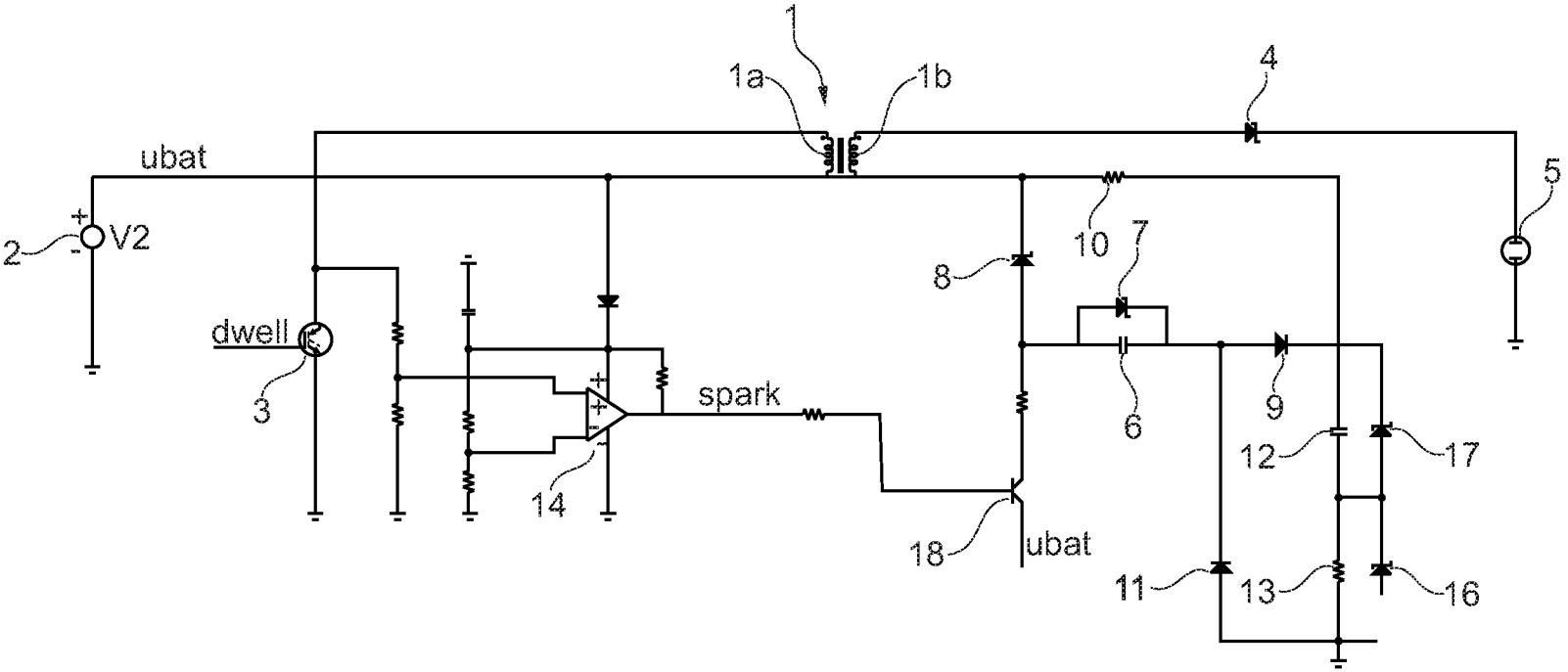
FIG. 2 shows a circuit diagram of an embodiment of a voltage transformer circuit according to this disclosure.

The voltage transformer circuit shown in FIG. 2 has a primary circuit and a secondary circuit, which are coupled by means of a transformer 1. A connector for a primary voltage source 2, for example a vehicle battery, a primary side 1*a* of the transformer 1 and a switch 3, for example a transistor switch, are contained in the primary circuit. When the switch 3 is closed, a primary current flows through the primary side 1*a* of the transformer 1, as a result of which a secondary voltage is induced in a secondary side 1*b* of the transformer 1. The primary side 1*a* and the secondary site 1*b* can be constructed as coils, which are coupled by means of a core of the transformer 1.

Figure 3:
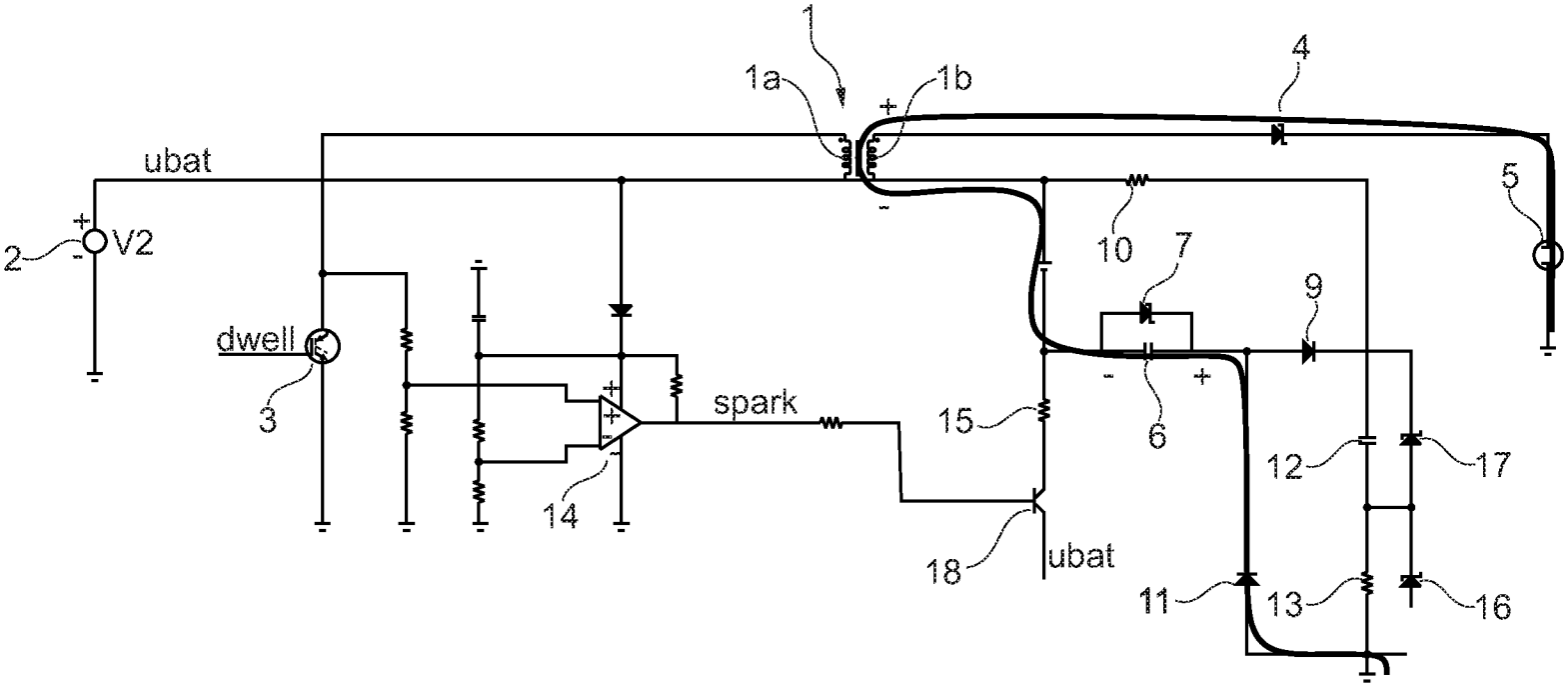
FIG. 3 shows the circuit diagram shown in FIG. 2 with the path of the current, which flows during an arc discharge of the spark plug.

In the secondary circuit, the secondary side 1*b* of the transformer 1 is connected in series to a switch-on spark suppression diode 4 and a connector for a spark plug 5, so that the secondary voltage effects an arc discharge between the electrodes of the spark plug 5. The essential path of the secondary current, which flows whilst an arc discharge burns, is drawn in FIG. 3.

A capacitor 6, which is bridged by a Zener diode 7 is connected in series to the secondary side 1*b* of the transformer 1. As can be seen, the secondary side 1*b* of the transformer 1 is arranged between the capacitor 6 and the connector for the spark plug 5. Both the capacitor 6 and the connector for the spark plug 5 are arranged between earth and the secondary side 1*b* of the transformer 1 in each case.

The capacitor 6 is arranged in a loop, which consists of a first branch with a first circuit element 8, for example a diode, and a second branch with a second circuit element 9, for example a diode. A resistor 10 of e.g. 10 kOhm or more can additionally be arranged in the second branch. Both sides of the capacitor 6 are connected in series to the same end of the secondary side 1*b* of the transformer 1 by means of the loop. In this case, the circuit elements 8, 9 are set up in such a manner that only a charging current of the capacitor 6 can flow through the first circuit element 8 and only a discharging current of the capacitor 6 can flow through the second circuit element 9. The circuit elements 8, 9 may be correspondingly controlled transistor switches or diodes for example, which are arranged in opposite orientation to one another.

If an arc discharge is burning in the spark plug 5, the capacitor 6 is therefore charged up to the breakdown voltage of the Zener diode 7. Thereafter, the current of the arc discharge flows through the Zener diode 7.

A circuit branch, which leads to ground and contains a diode 11 or a different circuit element which only allows current through in the direction of the secondary current flowing during an arc discharge, branches from the second branch of the loop between the capacitor 6 and the second circuit element 9.

In addition, a further circuit branch can branch from the second branch of the loop, on the side of the second circuit element 9 facing away from the capacitor 6, in which circuit branch a second capacitor 12 and a measuring resistor 13 connected in series to the same are arranged. The further circuit branch likewise leads to earth.

The first branch of the loop can be connected via a transistor switch 18 to a voltage source, for example the vehicle battery, between the first circuit element 8 and the capacitor 6. The transistor switch 18 is controlled in such a manner that it is open while an arc discharge burns.

After an arc discharge is extinguished, the transistor switch 18 is closed for an ionic current measurement. The transistor switch 18 can to this end be actuated by a control signal, the value of which indicates whether the primary voltage is applied on the primary side 1*a* of the transformer 1. A control signal of this type can, as shown in FIG. 2, be generated using an operational amplifier 14, which detects the potential at the transistor switch 3, e.g. at the collector thereof. Another option consists in evaluating the control signal of the switch 3.

When the primary circuit of the voltage transformer circuit is opened, the primary current comes to a stop and no more secondary voltage is induced in the secondary side 1*b* of the transformer 1, so that the arc discharge of the spark plug 5 extinguishes. In the voltage transformer circuit shown, the transistor switch 11 is then closed, so that the voltage source is applied over the resistor 15 at the capacitor 6. The capacitor 6 then charges the second capacitor 12, as is illustrated in a simplified manner in FIG. 4. For charging the second capacitor 12, it is not absolutely necessary that the capacitor 6 is connected to a voltage source via the resistor 15. Instead of being connected to voltage source, the capacitor 6 could inherently also be connected to earth, as the voltage of a vehicle battery is considerably smaller anyway than the charging voltage of the capacitor 6, which is more than 100 V.

So that, during the charging of the second capacitor 12, the measuring resistor 13 connected in series to the same or a voltage measuring device detecting the potential drop at the measuring resistor 13 is not unnecessarily loaded, the measuring resistor 13 can be bridged by a diode 16, which allows the charging current through. The second capacitor 12 can be bridged by a Zener diode 17, so that it can only be charged up to the breakdown voltage thereof.

After a charging period, which is only 1 to 10 ms for example, and can therefore be carried out in each engine cycle, the transistor switch 18 can be opened again, in order to carry out an ionic current measurement. Alternatively, the transistor switch 18 can also remain closed up to the next arc discharge, as the charging of the second capacitor 12 will soon have taken place up to the voltage level of the capacitor 6.

Figure 4:
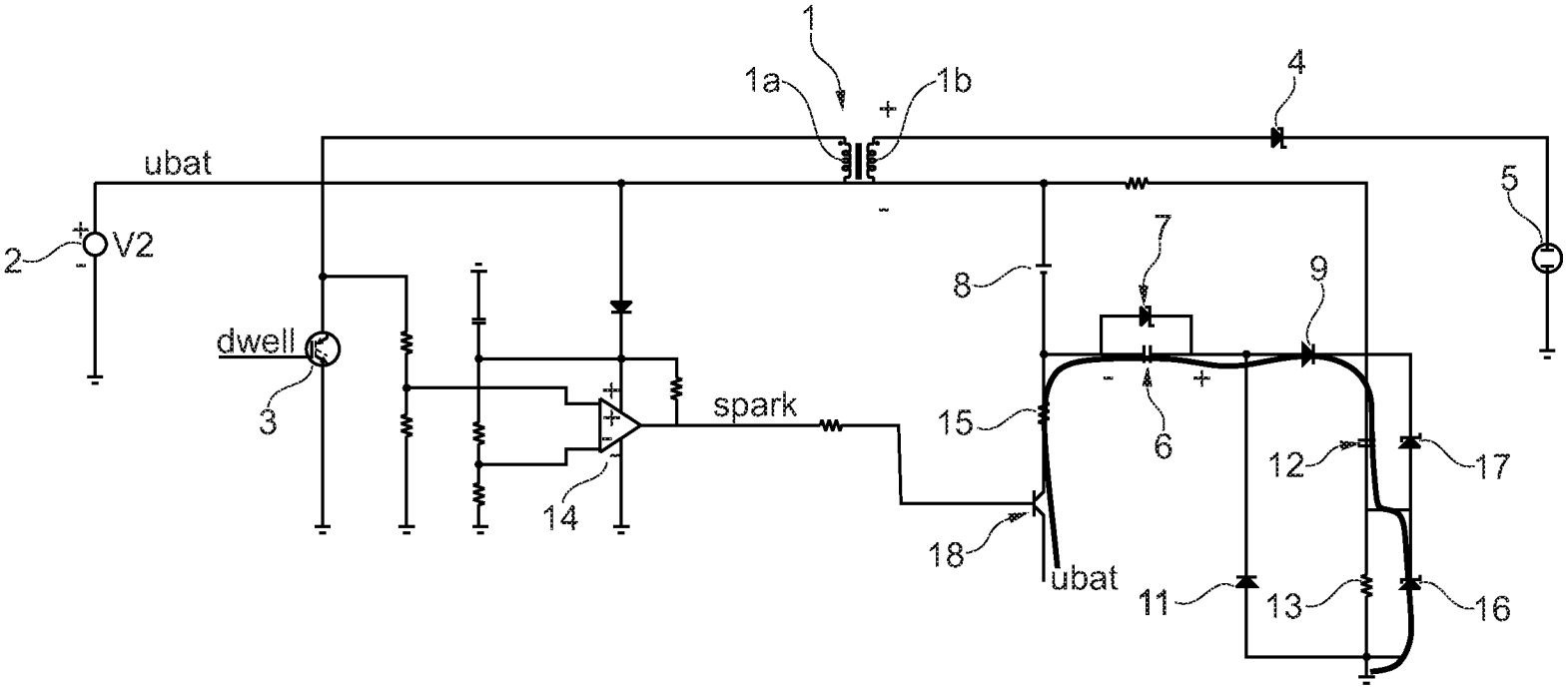
FIG. 4 shows the circuit diagram shown in FIG. 2 with the path of the current, which flows after an arc discharge.
Figure 5:
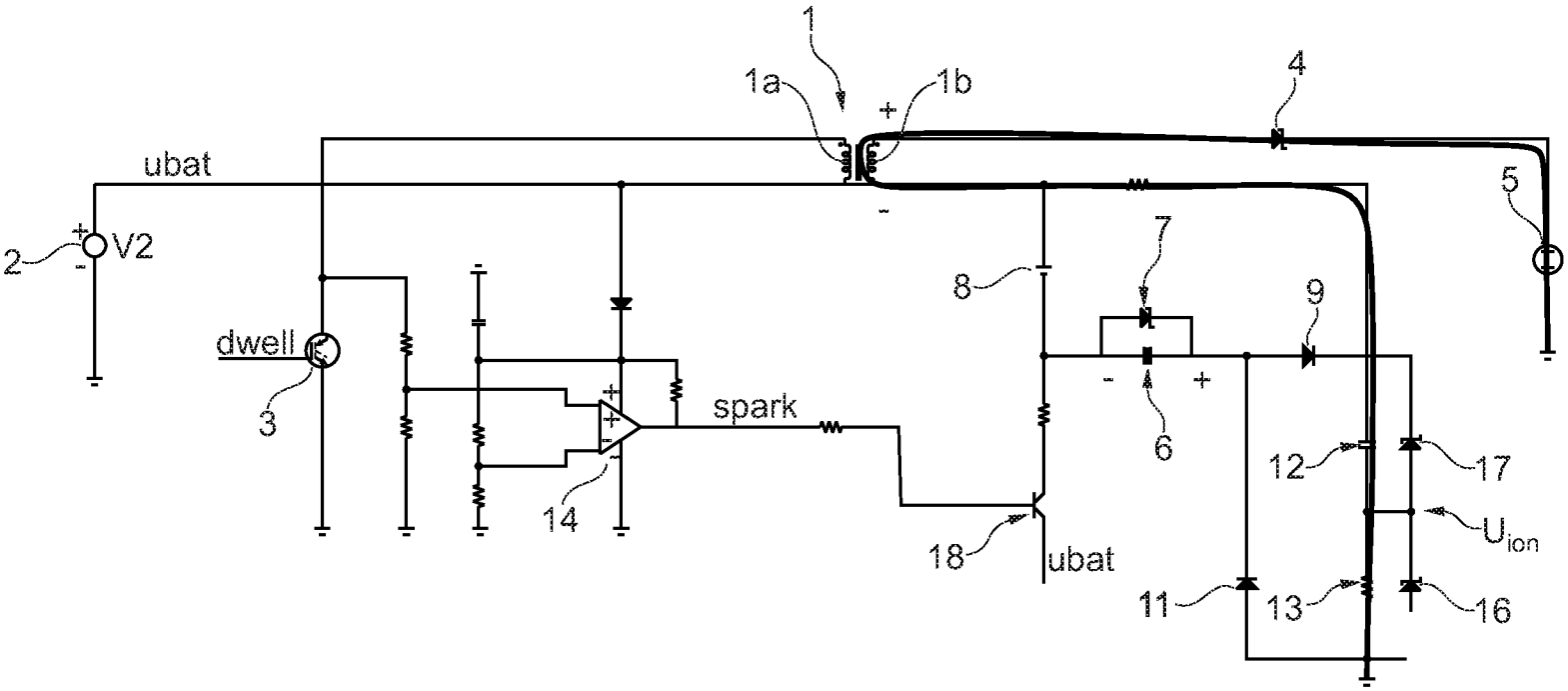
FIG. 5 shows the circuit diagram shown in FIG. 2 with the path of the ionic current.

After the recharging phase illustrated schematically in FIG. 4, an ionic current flows from the capacitor 12, as is sketched in a simplified manner in FIG. 5. The ionic current flows on the one hand from the capacitor 12 through the resistor 10 in the second branch of the loop, the secondary side 1*b* of the transformer 1, the switch-on spark suppression diode 4, the spark plug 5 and from there through the combustion chamber contents of the engine to earth. On the other hand, the ionic current flows from earth through the measuring resistor 13 to the capacitor 12, so that the ionic current can be measured as a voltage drop at the measuring resistor 13, which is indicated in FIG. 5 by means of the specification $U_{ION}$.

The charges delivered from the capacitor 12 for the ionic current therefore originate from the capacitor 6. Irrespectively of whether the ionic current is fed directly from the capacitor 6, which is possible in principle, or from the capacitor 12, which is charged by the capacitor 6, the charges of the capacitor 6 are therefore used in the described method for the ionic current, i.e. the capacitor 6 feeds the ionic current directly or indirectly via the second capacitor 12.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

What is claimed is:

1. A voltage transformer circuit for supplying a spark plug with ignition energy and for ionic current measurement, comprising:

a transformer having a primary side and a secondary side, the secondary side configured to generate a secondary voltage from a primary voltage applied on the primary side;

a primary circuit comprising the primary side of the transformer, a connector for a primary voltage source and a switch for closing the primary circuit; and a secondary circuit comprising in a series connection a capacitor, the secondary side of the transformer, a switch-on spark suppression diode and a connector for the spark plug;

wherein in the secondary circuit, the secondary side of the transformer is arranged between the capacitor and the connector for the spark plug and both the capacitor and the connector for the spark plug are each arranged between ground and the secondary side of the transformer;

wherein the capacitor is bridged by a Zener diode and is arranged in a loop which connects both sides of the capacitor to the same end of the secondary side of the transformer;

wherein a first circuit element is arranged in the loop on a first side of the capacitor between the capacitor and the secondary side of the transformer, said first circuit element being configured to only allow a charging current of the capacitor to pass, and a second circuit element is contained on a second side of the capacitor between the capacitor and the secondary side of the transformer, said second circuit element being configured to only allow a discharging current of the capacitor to pass.

2. The voltage transformer circuit according to claim 1, wherein the first circuit element is a first diode and the second circuit element is a second diode, which is orientated oppositely to the first diode.

3. The voltage transformer circuit according to claim 1, wherein a circuit branch branches from the loop between the capacitor and the second circuit element, which leads to ground and contains a third circuit element, which is configured to only allow a charging current of the capacitor through.

4. The voltage transformer circuit according to claim 3, wherein the third circuit element is a diode.

5. The voltage transformer circuit according to claim 1, wherein the loop is connected to a voltage source between the first circuit element and the capacitor via a transistor switch, wherein the transistor switch is actuated by a control signal, the value of which indicates whether the primary voltage is applied on the primary side of the transformer.

6. The voltage transformer circuit according to claim 1, wherein a further circuit branch branches from the loop on the side of the second circuit element facing away from the capacitor, which leads to ground and contains a second capacitor.

7. The voltage transformer circuit according to claim 6, wherein the second capacitor is bridged by a second Zener diode.

8. The voltage transformer circuit according to claim 6, wherein the second capacitor in the further circuit branch is connected in series to a measuring resistor for ionic current measurement.

9. The voltage transformer circuit according to claim 8, wherein the measuring resistor is bridged by a further Zener diode.

10. The voltage transformer circuit according to claim 1, wherein a resistor is arranged in the loop on the side of the second circuit element facing away from the capacitor.

11. A method for measuring an ionic current of a spark plug, comprising:

using a transformer to generate a secondary voltage from a primary voltage and applying the secondary voltage to the spark plug to ignite an electric arc;

using a current effected by the secondary voltage to charge a capacitor to a breakdown voltage of a Zener diode bridging the same, via a first branch, which leads from the transformer to a first of two sides of the capacitor, the first branch including a first circuit element configured to only allow a charging current of the capacitor to pass;

disconnecting the primary voltage from the transformer in order to extinguish the electric arc;

using the capacitor to deliver charges for an ionic current via a second branch, which connects the second side of the capacitor to the transformer, the second branch including a second circuit element configured to only allow a discharging current of the capacitor to pass, and obtaining a measuring signal of the ionic current by measuring a voltage drop at a measuring resistor.

12. The method according to claim 11, wherein at least a portion of the charges delivered from the capacitor for an ionic current measurement is temporarily stored in a second capacitor which is arranged in a third branch, which branches from the second branch.

13. The method according to claim 12, wherein the second capacitor is connected to earth via the measuring resistor.

* * * * *